US006789357B1

(12) United States Patent
McCullough

(10) Patent No.: US 6,789,357 B1
(45) Date of Patent: Sep. 14, 2004

(54) LIFT ASSIST MECHANISM FOR LIFTING LARGE ENCLOSURES

(75) Inventor: Andrew C. McCullough, Raymore, MO (US)

(73) Assignee: Smith & Loveless, Inc., Lenexa, KS (US)

( * ) Notice: Subject to any disclaimer, the term of this patent is extended or adjusted under 35 U.S.C. 154(b) by 0 days.

(21) Appl. No.: 10/434,591

(22) Filed: May 9, 2003

(51) Int. Cl.[7] ..... E05F 1/10
(52) U.S. Cl. ..... 49/386; 220/827
(58) Field of Search ..... 49/339, 345, 386; 220/264, 827, 828, 831, 832

(56) References Cited

U.S. PATENT DOCUMENTS 2,551,239 A 5/1951 Bond
2,688,764 A * 9/1954 Squire ..... 16/308
2,867,329 A 1/1959 Miller
4,327,522 A 5/1982 Meadows
4,452,015 A * 6/1984 Jacques et al. ..... 49/386
5,681,074 A 10/1997 Christensen
6,000,071 A * 12/1999 Fettes ..... 4/498
6,298,604 B1 10/2001 Rogers, Jr. et al.
6,343,828 B1 2/2002 Young et al.
6,367,123 B1 4/2002 Cheal et al.

* cited by examiner

*Primary Examiner*—Jerry Redman
(74) *Attorney, Agent, or Firm*—Wood, Phillips, Katz, Clark & Mortimer

(57) ABSTRACT

A lift assist mechanism for lifting a large enclosure that is pivotally attached to a body member, between a closed position, an intermediate position, and an open position. The lift assist mechanism includes a swing arm member and an expansible strut member. The swing arm member is pivotally attached to the body member at a first end and to a first end of the strut member at its second end. The second end of strut member is pivotally attached to the enclosure member. The pivot point between the swing arm member and the strut member pushes against a base plate associated with the body member when the enclosure member is in its closed and intermediate positions.

7 Claims, 2 Drawing Sheets

LIFT ASSIST MECHANISM FOR LIFTING LARGE ENCLOSURES

FIELD OF THE INVENTION

This invention is generally directed to a device or mechanism for assisting in the lifting of large enclosures. More specifically, this invention is directed to a device or mechanism for assisting in the lifting of a tall hood member that provides above-ground entry into the mechanical section of a buried pumping station.

BACKGROUND OF THE INVENTION

It has hereto been common practice to use gas shocks to assist in the opening or lifting of large or tall enclosures. This was typically accomplished using one of two methods. In the first method, the gas shocks were under-sized to allow the user to still be able to close the enclosure, while still providing a degree of assistance. In the second method, the travel of the enclosure is limited to forty five degrees. This permits the gas shocks to be sized correctly, but prevents the enclosure from being fully opened unless the gas shocks are uninstalled. Both of these options require the use of an end restraint to prevent the hood from over-extending the gas shock and thereby shortening its life.

The design of assist mechanisms that utilize gas shocks for enclosures that are tall presents unique problems. While the gas shocks will successfully lift the enclosure, in the full open position (approximately ninety degrees from horizontal), the center of gravity is located behind the hinge. As a consequence thereof, in order to close the enclosure, the operator is required to not only overcome the weight of the enclosure, but also the strength of the gas shocks. This in turn limits the strength of the shock that can be used, as a stronger shock would severely hamper an operator's ability to close the enclosure. Since the strength of the gas shock is limited, the amount of assistance that can be supplied in opening the enclosure is also limited.

The alternative is to limit the travel of the enclosure such that the gas shocks do not push the center of gravity of the enclosure past the hinge. In some applications, this only allows for the enclosure to be opened about forty five degrees instead of ninety degrees. Some applications have allowed the gas shocks to be removed as a part of operating the enclosure when it is necessary to open it beyond the travel of the gas shocks.

Additionally, it has heretofore been necessary to take great care to prevent the gas shocks from over-extending, such as the utilization of an end-stop. If the gas shocks are permitted to fully extend before the endstop is engaged, the weight of the enclosure will tend to over-extend the shocks and thereby greatly reduce their useful life.

SUMMARY OF THE INVENTION

In accordance with the present invention, a left assist mechanism is provided that decreases the work required by an operator to fully open an enclosure or hood for entry into a mechanical section of a system, such as a wastewater or sewage pumping station.

The lift assist mechanism includes a swing arm member and an expandable strut or gas shock member. The swing arm member has a first end portion pivotally attached to the body member and a second end portion pivotally attached to a first end portion of the strut member. The strut member has a second end portion that is pivotally attached to the enclosure member.

The body member has a base plate member associated therewith. The strut member has a contracted condition when the enclosure member is in its closed portion and an extended condition when the enclosure member is in its intermediate and fully open position. The pivot point between the swing arm member and the first end of the enclosure member is pressed against the base plate when the enclosure member is in its closed and intermediate positions. The pivot point between the swing arm member and the first end of the enclosure member is lifted up from the base plate member when the enclosure member is in its open position.

BRIEF DESCRIPTION OF THE DRAWINGS

These and other features of the invention will appear from the following written description, and from the drawings, in which.

DESCRIPTION OF THE PREFERRED EMBODIMENT

Figure 1:
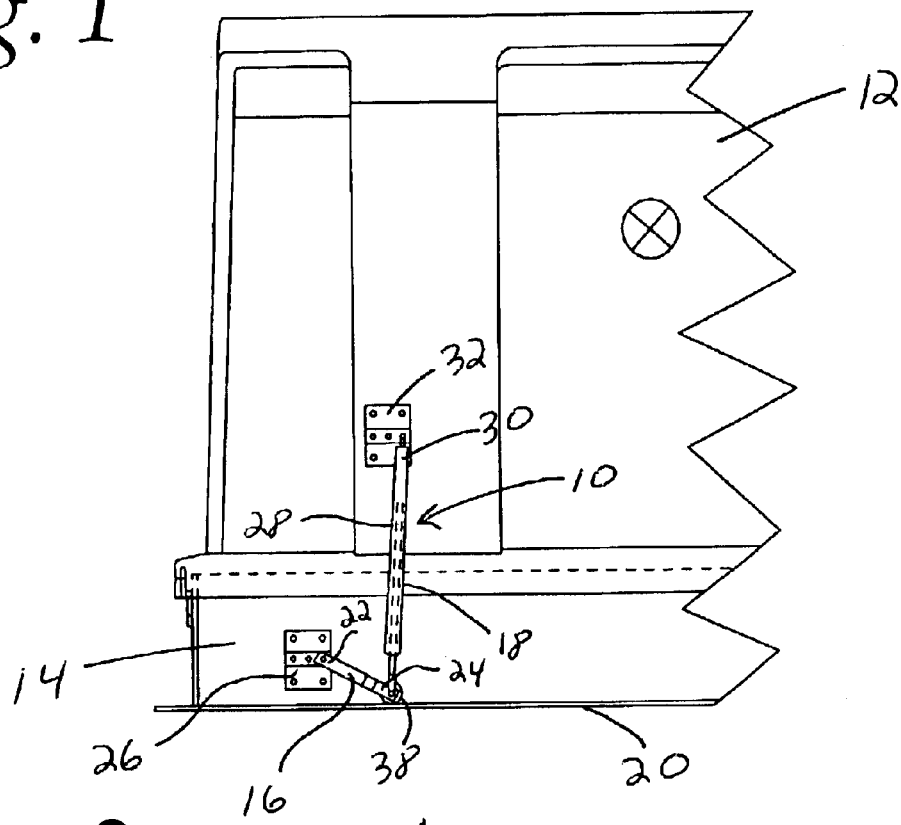
FIG. 1 is a schematic elevational view showing the lift mechanism in accordance with the invention, with the enclosure member in its closed position.
Figure 2:
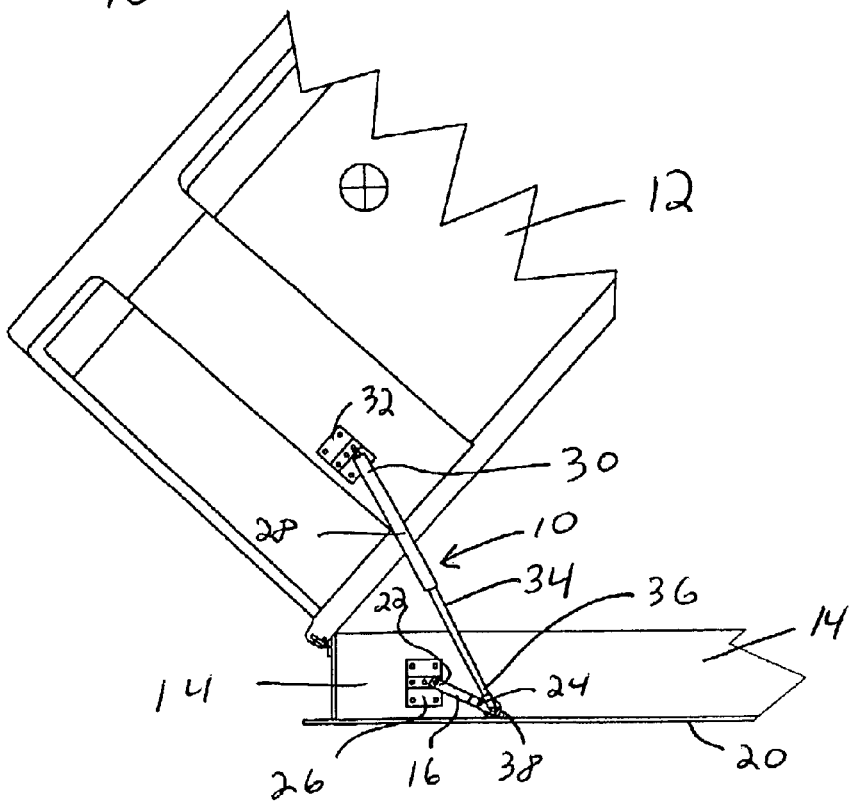
FIG. 2 is a similar view of FIG. 1, but showing the enclosure member in its intermediate position.
Figure 3:
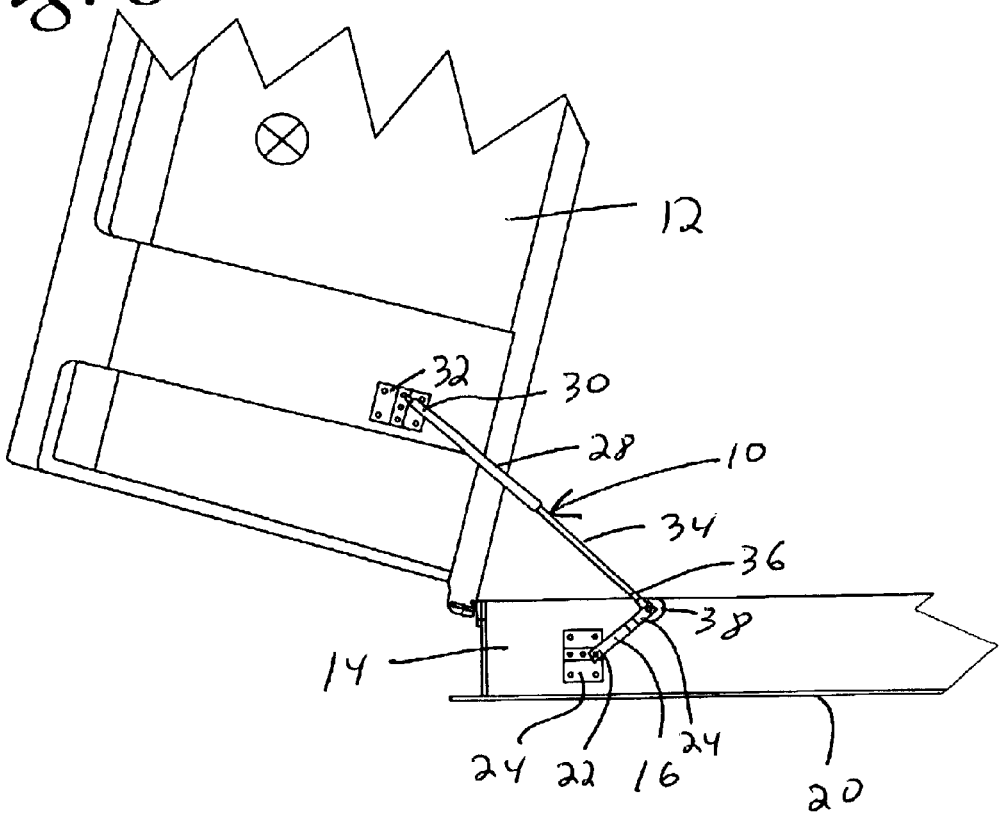
FIG. 3 is a similar view to FIG. 1, but showing the enclosure member in its fully open position.

Referring to FIGS. 1–3, a lift assist mechanism is constructed in accordance with the present invention is indicated at 10. Lift assist mechanism 10 is shown in combination with an enclosure or hood member 12 associated with the body portion 14 that houses a mechanical system, such as a wastewater or sewage pumping station. The present invention is particularly applicable for use in connection with heavy enclosure members that have a tail profile.

Lift assist mechanism 10 comprises a swing arm member 16, and an expansible strut member or gas shock 18. It is contemplated that a lift assist mechanism 10 may be provided on each side of the enclosure member 12 to facilitate opening and closing of the enclosure member. The enclosure member 12 is pivotally hinged to the body portion 14 in any well-known manner. The body portion 14 is provided with a base plate 20 extending therefrom.

Swing arm member 16 is a link arm member having a first end portion 22 and a second end portion 24. The first end portion 22 is pivotally attached to the body portion 14. The first end portion 22 is preferably pivotally attached to a first bracket member 26 suitably attached to the body portion 14. Bracket member 26 is preferably provided with a plurality of spaced apart openings through which a pivot pin passing through the first end portion 22 may extend.

The expansible strut member 18 is preferably a conventional gas strut or shock member having a cylinder portion 28 defining a first end 30 portion and a rod portion 34 defining a second end portion 36. The second end portion 36 of strut member 18 is pivotally attached to the second end portion 24 of swing arm member 16. The first end portion 30 of strut member 18 is pivotally attached to a side portion of the enclosure member 12. The first end portion 30 is preferably pivotally attached to a second bracket member 32 suitably attached to the enclosure member 12. Bracket member 32 is provided with a plurality of spaced apart openings through which a pivot pin passing the second end portion 30 of the strut member 18 may extend.

For reasons that will hereinbelow become more apparent, the pivot point between the swing arm member 16 and the strut member 18 is urged into contact with the base plate 20 by the force of the gas strut and the weight of the enclosure when the enclosure is in its closed and intermediate positions. A suitable bumper member 38 is preferably provided at the pivot point between the swing arm member and the strut member.

Referring to FIG. 1, the enclosure member 12 is shown in its closed position in covering relationship to the body portion 14. The gas strut 18 is in its contracted condition and the bumper member 38 is in contact with and pushing on the base plate 20.

Referring to FIG. 2, when it is desired to gain access to the body portion 14, the operator provides an upward lifting force to the enclosure member 12. In so doing, the strut member assists in the lifting of the enclosure member into an intermediate or partially open position. In the intermediate position, the strut member is fully extended and supports the weight of the enclosure member. The bumper 38 is still pressed against the base plate 20 by the force of the strut member and the weight of the enclosure member.

Referring to FIG. 3, continued lifting of the enclosure member 12 into its fully open position, causes the bumper member 38 to be lifted off the base plate due to the presence of the swing arm member 16. At this point, the strut member 18 is neither assisting nor detracting from the opening or closing of the enclosure member. The inclusion of the pivot point permits the strength of the strut member to be increased without adding to the difficulty associated with the closing of the enclosure member. The operator does not have to overcome the adverse moment generated by the strut member while moving the enclosure member from its fully open position to its intermediate position.

Figure 4:
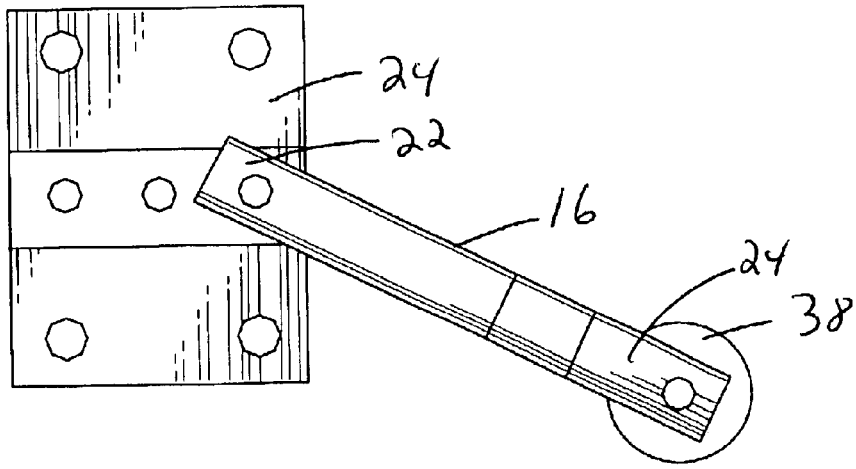
FIG. 4 is a schematic view showing the attachment of the swing arm member to the bracket member.

Referring to FIG. 4, to increase the effectiveness of the strut member, and hence its strength, the swing arm 16 may be moved to an opening in the bracket member 26 furthest from the hinge between the enclosure member 12 and the body portion 14. This extends the useful life of the strut member 18 as permits adjustment of the assist to the operator's taste.

The foregoing disclosure is the best mode devised by the inventor for practicing this invention. It is apparent, however, that apparatus incorporating modifications and variations will be obvious to one skilled in the art. Insomuch as the foregoing disclosure is intended to enable one skilled in the pertinent art to practice the instant invention, it should not be construed to be limited thereby but should be construed to include such aforementioned obvious variations and be limited only by the spirit and scope of the following claims.

What is claimed is:

1. In combination, a lift assist mechanism for assisting in the pivotal movement and lifting of an enclosure member with respect to a body member between a closed position, an intermediate position, and an open position, comprising:

a body member, said body member having base plate associated therewith;

an upstanding enclosure member pivotally attached along at least one edge thereof to said body member so as to permit said enclosure member to move between a closed position, an intermediate position, and an open position;

a swing arm member having a first end portion and a second end portion, said first end portion of said swing arm being pivotally connected to said body member;

an expansible strut member having a first end portion and a second end portion, said first end portion of said strut member being pivotally connected to said second end portion of said swing arm member and said second end portion of said strut being pivotally connected to said enclosure member, said strut having a contracted condition when the enclosure member is in its closed position and an extended condition when said enclosure is in its intermediate and open positions;

whereby when said enclosure member is in its closed and intermediate positions said second end of said swing arm member and said first end of said strut member are in contact with said base plate, and when said enclosure member is in its open position said second end of said swing arm member and said first end of said strut member are spaced from said base plate member so that said strut member is neither assisting nor detracting from the opening or closing of the enclosure member.

2. The combination as set forth in claim 1, wherein:

said expandible strut member is a gas shock member.

3. The combination as set forth in claim 1, wherein:

said first end portion of said swing arm member is pivotally attached to a first bracket member attached to said body member.

4. The combination as set forth in claim 1, wherein:

said second end portion of said strut is pivotally attached to a second bracket member attached to said enclosure member.

5. The combination as set forth in claim 3, wherein:

said first bracket member has a plurality of spaced apart openings formed therein so that the location of the first end portion swing arm member relative to the body member may be adjusted.

6. The combination as set forth in claim 4, wherein:

said second bracket member has a plurality of spaced apart openings formed therein so that the location of the second end portion of the strut member relative to the enclosure member may be adjusted.

7. The combination as set forth in claim 1, wherein:

a bumper member is provided at the pivot point between the second end portion of the swing member and the first end portion of the strut member to contact the base plate when the enclosure is in its closed and intermediate positions.

* * * * *